US009903190B2

(12) United States Patent
Conrad et al.

(10) Patent No.: US 9,903,190 B2
(45) Date of Patent: Feb. 27, 2018

(54) MODULAR FRACTURING SYSTEM

(71) Applicant: Cameron International Corporation, Houston, TX (US)

(72) Inventors: Gregory A. Conrad, Calgary (CA); James W. Lovin, Edmonton (CA)

(73) Assignee: Cameron International Corporation, Houston, TX (US)

( * ) Notice: Subject to any disclaimer, the term of this patent is extended or adjusted under 35 U.S.C. 154(b) by 320 days.

(21) Appl. No.: 14/525,180

(22) Filed: Oct. 27, 2014

(65) Prior Publication Data

US 2016/0115773 A1 Apr. 28, 2016

(51) Int. Cl.
*E21B 43/26* (2006.01)

(52) U.S. Cl.
CPC ..... *E21B 43/26* (2013.01)

(58) Field of Classification Search
CPC ..... E21B 43/26; E21B 43/247; E21B 43/12; F16L 27/12; F16L 15/02; F16L 2201/30; Y10T 137/85938; Y10T 29/49826
USPC ..... 166/308.1, 177.5, 67, 271
See application file for complete search history.

(56) References Cited

U.S. PATENT DOCUMENTS

| | | | |
|---|---|---|---|
| 1,615,536 | A | 1/1927 | Del Mar |
| 3,233,668 | A | 2/1966 | Hamilton et al. |
| 4,355,961 | A | 10/1982 | Riggs |
| 4,366,864 | A | 1/1983 | Gibson et al. |
| 4,570,673 | A | 2/1986 | Kendrick et al. |
| 4,603,887 | A | 8/1986 | Mayfield et al. |
| 4,767,136 | A | 8/1988 | Lehmann |
| 6,234,030 | B1 | 5/2001 | Butler |
| 6,364,024 | B1 | 4/2002 | Dallas |
| 8,839,867 | B2 | 9/2014 | Conrad |
| 8,905,056 | B2 | 12/2014 | Kendrick |
| 8,978,763 | B2 | 3/2015 | Guidry |
| 9,068,450 | B2 | 6/2015 | Guidry |
| 9,127,545 | B2 | 9/2015 | Kajaria et al. |
| 9,222,345 | B2 | 12/2015 | Conrad |
| 9,255,469 | B2 | 2/2016 | Conrad |
| 2003/0205378 | A1 | 11/2003 | Wellington et al. |
| 2003/0205385 | A1 | 11/2003 | Duhn et al. |
| 2004/0251020 | A1 | 12/2004 | Smith |
| 2008/0277120 | A1 | 11/2008 | Hickie |
| 2009/0261575 | A1 | 10/2009 | Bull et al. |
| 2010/0051261 | A1 | 3/2010 | Koleilat et al. |
| 2010/0300672 | A1 | 12/2010 | Childress et al. |
| 2011/0108275 | A1 | 5/2011 | Borak et al. |
| 2011/0114320 | A1 | 5/2011 | Sponchia et al. |
| 2011/0132596 | A1 | 6/2011 | Yeh et al. |
| 2011/0259584 | A1 | 10/2011 | Broussard, II |

(Continued)

FOREIGN PATENT DOCUMENTS

| | | |
|---|---|---|
| CA | 2178856 | 12/1997 |

*Primary Examiner* — George Gray
(74) *Attorney, Agent, or Firm* — Eubanks PLLC

(57) ABSTRACT

A modular fracturing system including a fracturing fluid manifold and a skid apparatus coupled in fluid communication with the fracturing fluid manifold and only one fracturing tree. The skid apparatus can include an inlet coupled to the fracturing fluid manifold, a single outlet coupled to the one fracturing tree via a fluid conduit, and a valve between the inlet and the single outlet to control flow of fracturing fluid from the fracturing fluid manifold through the skid apparatus to the one fracturing tree.

20 Claims, 6 Drawing Sheets

(56) References Cited

U.S. PATENT DOCUMENTS

| | | | | |
|---|---|---|---|---|
| 2012/0181015 | A1* | 7/2012 | Kajaria | E21B 43/26 166/177.5 |
| 2012/0181016 | A1 | 7/2012 | Kajaria et al. | |
| 2012/0181030 | A1 | 7/2012 | Kajaria et al. | |
| 2013/0075080 | A1* | 3/2013 | Guidry | E21B 43/26 166/177.5 |
| 2013/0076026 | A1 | 3/2013 | Guidry | |
| 2013/0175038 | A1 | 7/2013 | Conrad | |
| 2013/0284455 | A1 | 10/2013 | Kajaria et al. | |
| 2014/0238683 | A1 | 8/2014 | Korach et al. | |
| 2014/0246211 | A1 | 9/2014 | Guidry et al. | |
| 2015/0354313 | A1* | 12/2015 | McClinton | E21B 23/06 166/135 |
| 2016/0024857 | A1 | 1/2016 | Guidry | |

* cited by examiner

MODULAR FRACTURING SYSTEM

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in searching for and extracting oil, natural gas, and other subterranean resources from the earth. Particularly, once a desired subterranean resource is discovered, drilling and production systems are often employed to access and extract the resource. These systems may be located onshore or offshore depending on the location of a desired resource. Further, such systems generally include a wellhead assembly through which the resource is extracted. These wellhead assemblies may include a wide variety of components, such as various casings, valves, fluid conduits, and the like, that control drilling or extraction operations.

Additionally, such wellhead assemblies may use fracturing trees and other components to facilitate a fracturing process and enhance production from wells. As will be appreciated, resources such as oil and natural gas are generally extracted from fissures or other cavities formed in various subterranean rock formations or strata. To facilitate extraction of such a resource, a well may be subjected to a fracturing process that creates one or more man-made fractures in a rock formation. This facilitates, for example, coupling of pre-existing fissures and cavities, allowing oil, gas, or the like to flow into the wellbore. Such fracturing processes typically include injecting a fracturing fluid—which is often a mixture including sand and water—into the well to increase the well's pressure and form the man-made fractures. A fracturing manifold may provide fracturing fluid to wells through lines (e.g., pipes) coupled to fracturing trees of wellhead assemblies.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Some embodiments of the present disclosure generally relate to fracturing systems including manifolds and skid assemblies for supplying fracturing fluid to wells. In certain embodiments, a fracturing system includes dedicated skid assemblies each coupled to provide fracturing fluid to a single wellhead assembly from a shared fracturing manifold. Each of the dedicated skid assemblies can have a single fluid outlet that is coupled to a fracturing tree of its wellhead assembly via a single fluid conduit. Such an arrangement allows the dedicated skid assemblies to be placed closely to their respective wellhead assemblies, such as directly in front of the fracturing trees of the wellhead assemblies. In some instances, the skid assemblies are coupled to an additional manifold for providing an additional fluid to the wellhead assemblies via the single fluid outlet of each skid assembly.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of the some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
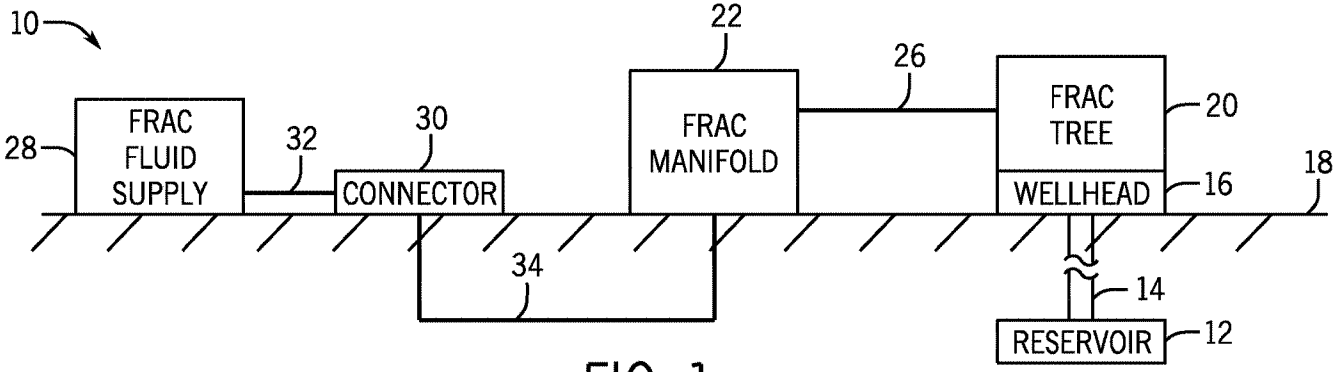
FIG. 1 generally depicts a fracturing system in accordance with an embodiment of the present disclosure.
Figure 2:
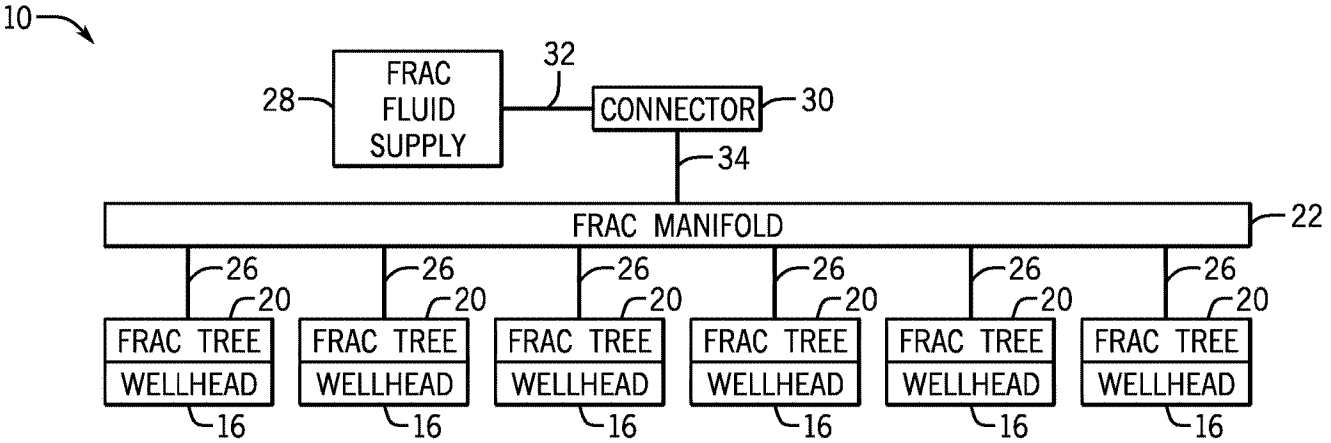
FIG. 2 is a block diagram of the fracturing system of FIG. 1 with a fracturing manifold coupled to multiple fracturing trees in accordance with one embodiment.

Turning now to the present figures, an example of a fracturing system 10 is provided in FIGS. 1 and 2 in accordance with one embodiment. The fracturing system 10 facilitates extraction of natural resources (e.g., oil or natural gas) from a reservoir 12 via a well 14 and a wellhead 16. Particularly, by injecting a fracturing fluid down the well 14 into the reservoir 12, the fracturing system 10 increases the number or size of fractures in a formation to enhance recovery of natural resources present in the formation. In the presently illustrated embodiment, the well 14 is a surface well accessed through equipment of wellhead 16 installed at surface level (i.e., on ground 18). But it will be appreciated that natural resources may be extracted from other wells, such as platform or subsea wells.

The fracturing system 10 includes various components to control flow of a fracturing fluid into the well 14. For instance, the depicted fracturing system 10 includes a fracturing tree 20 and a fracturing manifold system 22. The fracturing tree 20 is coupled to the wellhead 16 and can be considered part of a wellhead assembly, which includes the wellhead 16 and other coupled components. The fracturing tree 20 can be mounted above the wellhead 16 or can be a horizontal fracturing tree connected to a side of the wellhead 16. Still further, the fracturing tree 20 can include at least one valve that controls flow of the fracturing fluid into the wellhead 16 and, subsequently, down the well 14 to the reservoir 12. Similarly, the fracturing manifold system 22 can include at least one valve that controls flow of the fracturing fluid to the fracturing tree 20 by a conduit or fluid connection 26 (e.g., pipes).

As depicted in FIG. 2, the fracturing manifold system 22 is connected to provide fracturing fluid to multiple fracturing trees 20 and wellheads 16. But it is noted that the fracturing manifold system 22 may instead be coupled to a single fracturing tree 20 in full accordance with the present techniques. As discussed in greater detail below, various components of the fracturing manifold system 22 can be mounted on skids to facilitate movement of the fracturing manifold system 22 with respect to the ground 18 and installation of the system 22 at a wellsite.

Fracturing fluid from a supply 28 is provided to the fracturing manifold system 22. In FIG. 1, a connector 30 receives fracturing fluid from the supply 28 through a conduit or fluid connection 32 (e.g., pipes or hoses) and then transmits the fluid to the fracturing manifold system 22 by way of a subterranean conduit or fluid connection 34 (e.g., pipes). The fluid connection 34 could be provided above the ground 18 in other instances. In one embodiment, the fracturing fluid supply 28 is provided by one or more trucks that deliver the fracturing fluid, connect to the connector 30, and pump the fluid into the fracturing manifold system 22 via the connector 30 and connections 32 and 34. In another embodiment, the fracturing fluid supply 28 is in the form of a reservoir from which fluid may be pumped into the fracturing manifold system 22. But any other suitable sources of fracturing fluid and manners for transmitting such fluid to the fracturing manifold system may instead be used.

Figure 3:
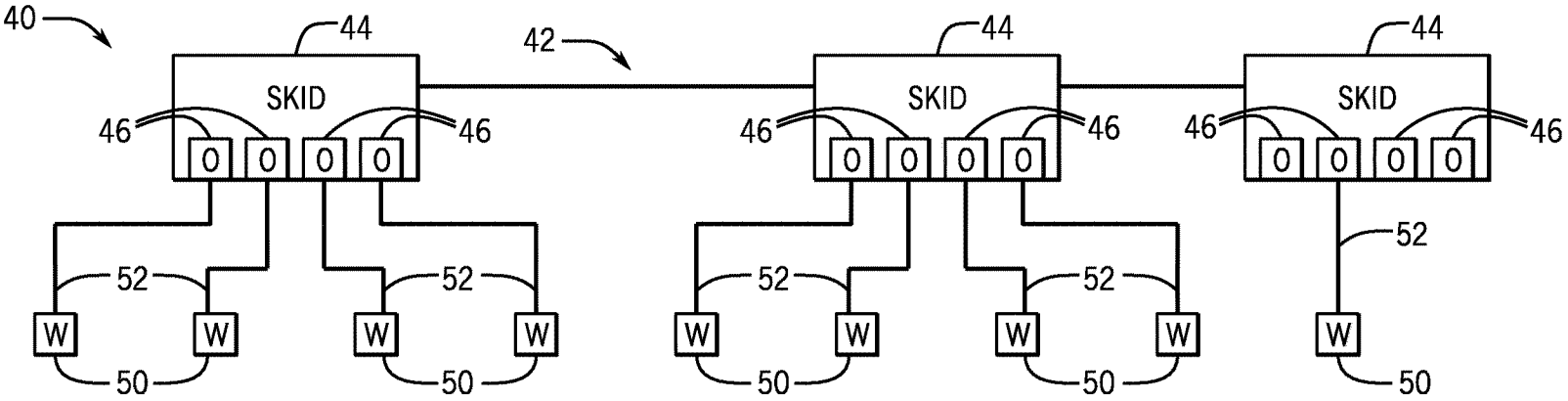
FIG. 3 is a block diagram of a fracturing system having skid assemblies with multiple fluid outlets for routing fracturing fluid to wellhead assemblies in accordance with one embodiment.

Components of a fracturing manifold system 40 coupled to wellhead assemblies 50 are generally depicted in FIG. 3 by way of example. In this embodiment, the fracturing manifold system 40 includes a fracturing manifold line 42 coupled to skid apparatuses or assemblies 44. Fracturing fluid pumped through the fracturing manifold line 42 to the skid apparatuses 44 can be routed from fracturing fluid outlets 46 of the skid apparatuses 44 to the wellhead assemblies 50 through fluid conduits 52, which can be coupled to fracturing trees of the wellhead assemblies 50. In some embodiments, each wellhead assembly 50 is coupled to receive fracturing fluid from a single (i.e., only one) skid apparatus 44 by a single fluid conduit 52. But in other instances multiple fluid conduits 52 could be used to couple a wellhead assembly 50 to receive fracturing fluid from one or more skid apparatuses 44.

Each of the skid apparatuses 44 is depicted in FIG. 3 as having four outlets 46, allowing the skid apparatus 44 to be connected to four different wellhead assemblies 50. In some embodiments, the skid apparatuses 44 could include a different number of outlets 46, such as two or three. Further, the skid apparatuses 44 could have different numbers of fracturing fluid outlets 46, such as some skid apparatuses 44 having two fracturing fluid outlets 46 and others having four fracturing fluid outlets 46. Having multiple fracturing fluid outlets 46 on the skid apparatuses 44 facilitates connection of a skid apparatus 44 to multiple wellhead assemblies 50 and may reduce the number of skid apparatuses 44 needed at a particular wellsite.

Figure 4:
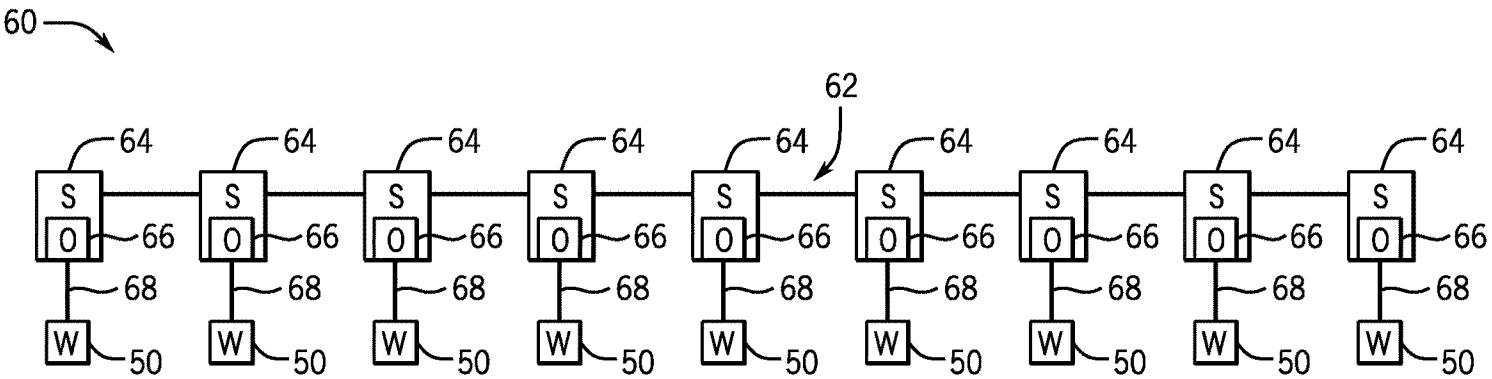
FIG. 4 is a block diagram of a modular fracturing system with skid assemblies each having only a single fluid outlet for routing fracturing fluid to just one wellhead assembly in accordance with one embodiment.

In other embodiments, however, one or more skid apparatuses are provided with a single fracturing fluid outlet for connection to a single wellhead assembly. One example of such an arrangement is generally depicted in FIG. 4. In this embodiment, a fracturing manifold system 60 includes a fracturing manifold line 62 coupled to skid assemblies or apparatuses 64. The fracturing manifold line 62, like the fracturing manifold line 42, can include various pipes and connection blocks to enable distribution of fracturing fluid to the connected skid apparatuses. Fracturing fluid received by the skid apparatuses 64 can be routed via fracturing fluid outlets 66 to wellhead assemblies 50 via fluid conduits 68.

In at least some instances, each skid apparatus 64 includes a single fracturing fluid outlet 66, which is coupled to a single wellhead assembly 50 by a single fluid conduit 68. In such a modular arrangement, each wellhead assembly 50 can be said to have its own dedicated skid apparatus 64 and the ratio of wellhead assemblies 50 to skid apparatuses 64 is one to one. Further, this modular arrangement allows each dedicated skid apparatus 64 to be positioned directly in front of its respective wellhead assembly 50 (e.g., in front of a horizontal fracturing tree). This can reduce the length of the fluid conduits 68 compared to other arrangements (e.g., system 40) in which skid apparatuses are shared by multiple wellhead assemblies, which can require longer fluid conduits to connect the skid apparatuses to more distant wellhead assemblies. The fracturing manifold system 60 in other embodiments could include skid apparatuses with different numbers of fluid outlets for connection to varying numbers of wellhead assemblies, such as some skid apparatuses each having a single fluid outlet for connection to a single wellhead assembly and other skid apparatuses each having multiple fluid outlets for connection to multiple wellhead assemblies.

Figure 5:
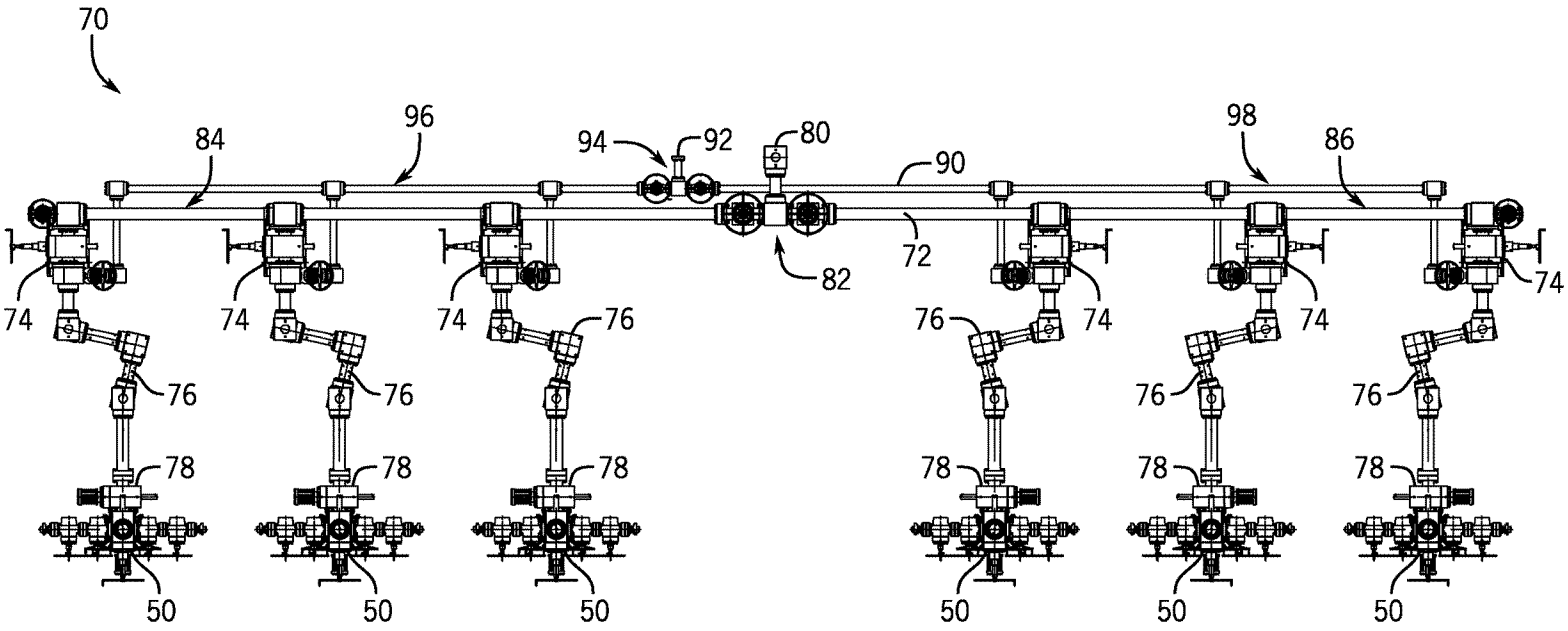
FIGS. 5 and 6 are plan views of fracturing systems with skid assemblies each coupled by a single fluid conduit to a respective fracturing tree of a wellhead assembly in accordance with certain embodiments.
Figure 6:
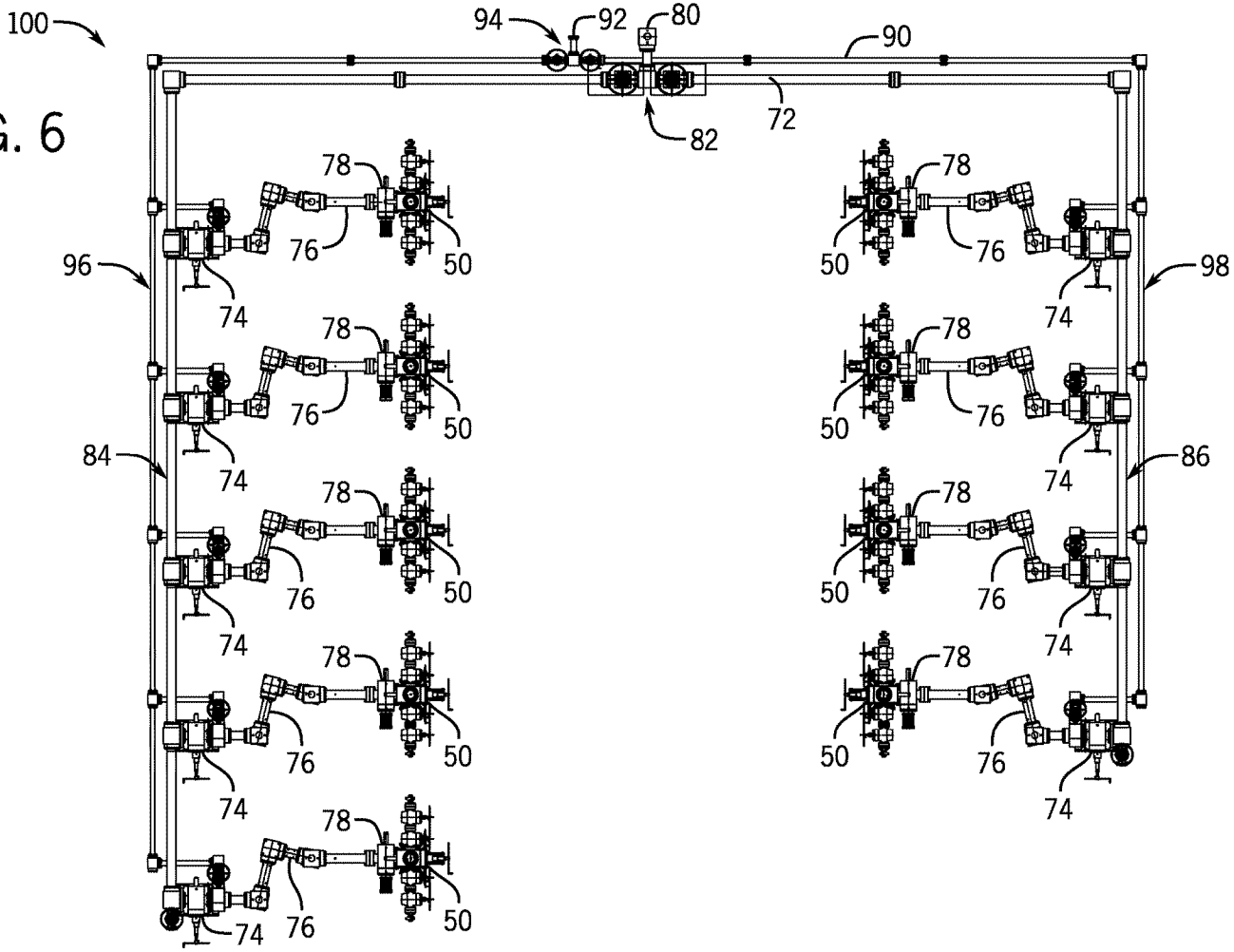

Two examples of fracturing manifold systems with modular designs are depicted in FIGS. 5 and 6. In these embodiments, a fracturing manifold system 70 (FIG. 5) and a fracturing manifold system 100 (FIG. 6) each include a fracturing fluid manifold 72 coupled to skid apparatuses or assemblies 74. These skid assemblies 74 are connected by fluid lines or conduits 76 to fracturing trees 78 of the wellhead assemblies 50, with a one-to-one ratio of skid assemblies 74 to fracturing trees 78. Each skid assembly 74 includes a single fracturing fluid outlet that is connected to one respective fracturing tree 78 by a single fluid conduit 76. As shown here, the fluid conduits 76 include pipes and elbow joints to facilitate connection between the skid assemblies 74 and the fracturing trees 78. But the fluid conduits 76 may be provided in different forms in other embodiments.

Fracturing fluid can be supplied to the fracturing fluid manifold 72 through an inlet 80. As depicted in FIGS. 5 and 6, the fracturing fluid manifold 72 includes a series of pipes connected between connection blocks coupled to and supported on the skid assemblies 74. In other instances, the connection blocks of the fracturing fluid manifold 72 could be set back from the skid assemblies 74. The depicted fracturing fluid manifold 72 also includes a splitter 82 with valves for controlling flow of fracturing fluid into branch lines 84 and 86 to the left and right of the splitter 82. Although the splitter 82 is shown here as a two-way splitter for routing fracturing fluid to the two branch lines 84 and 86, in other embodiments the splitter 82 could be connected to more than two branch lines. During a fracturing operation, the splitter 82 can be operated to provide fracturing fluid to either or both of the branch lines 84 and 86, and valves of the skid assemblies 74 can be operated to supply fracturing fluid from the branch lines to the wellhead assemblies 50. In FIG. 5, the branch lines 84 and 86 are each coupled to the same number of skid assemblies 74, whereas in FIG. 6 the branch lines 84 and 86 are coupled to a different number of skid assemblies 74.

In some instances, an additional manifold can be coupled to the skid assemblies of the fracturing system. For instance, in FIGS. 5 and 6, an additional manifold 90 is coupled to the skid assemblies 74. In one embodiment, the additional manifold 90 is a pump-down manifold for routing fluid to wellhead assemblies 50 to pump a downhole tool (e.g., a wireline tool having a plug or a perforating gun) down the wells. The additional manifold 90 is depicted as including a fluid inlet 92 and a splitter 94 for controlling flow of fluid into branch lines 96 and 98 coupled to the skid assemblies 74. As discussed in greater detail below, in some embodiments each of the skid assemblies 74 has separate inlets connected to the fracturing fluid manifold and the additional manifold, but has a single, common outlet for supplying fluids from the multiple manifolds to a connected wellhead assembly 50 via a single fluid conduit 76. In such embodiments, the ability to provide fluid from the additional manifold through the same skid assemblies and out to the wellhead assemblies via the same outlets and fluid conduits used to convey the fracturing fluid to the wellhead assemblies can eliminate the need for separate, additional fluid connections to the wellhead assemblies to provide such fluid.

Figure 7:
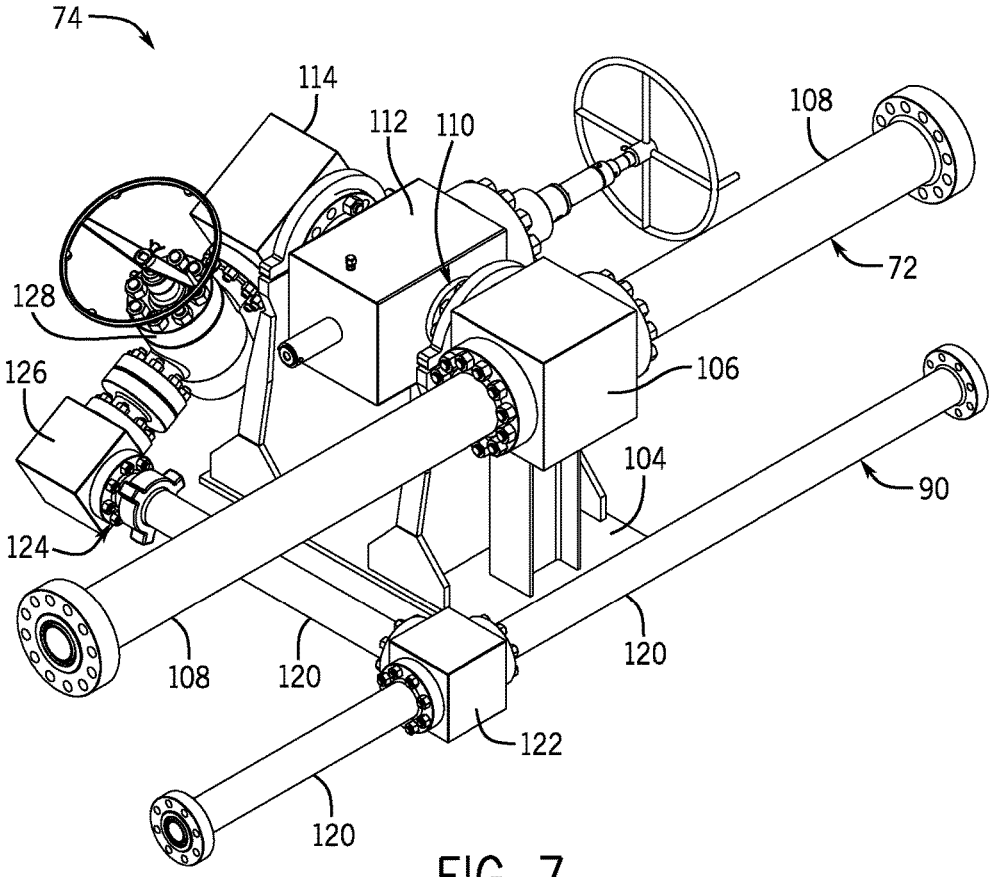
FIGS. 7 and 8 are perspective views showing additional details of one of the skid assemblies depicted in FIGS. 5 and 6 in accordance with one embodiment.
Figure 8:
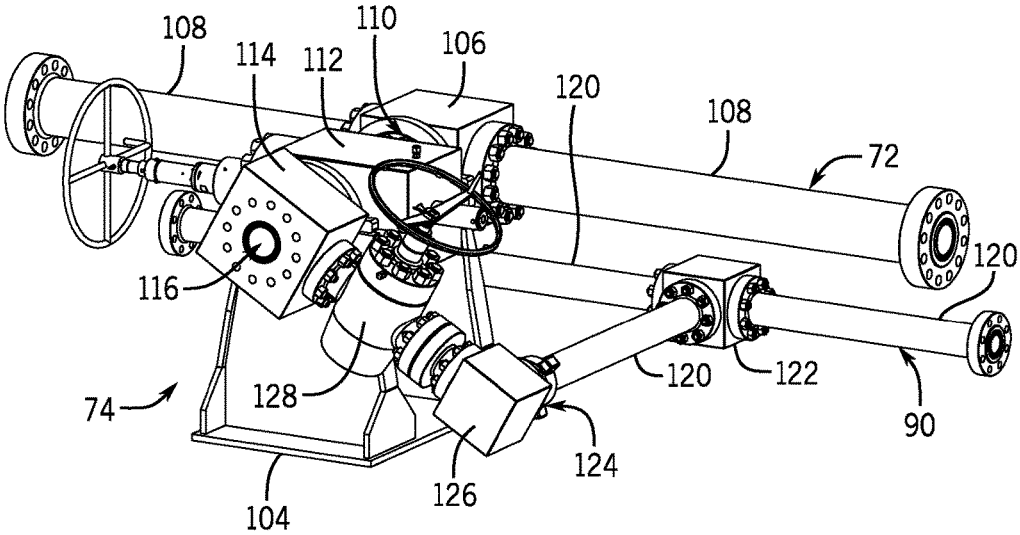

An example of one of the skid assemblies 74 is shown in greater detail in FIGS. 7 and 8. The depicted skid assembly 74 includes a flow control assembly having various components mounted on a skid 104. A connection block 106 of the fracturing manifold 72 is supported on the skid 104 and can be connected to connection blocks of other skid assemblies 74 via manifold pipes 108. In one embodiment, the manifold pipes 108 have a diameter equal to that of the fluid conduit 76 (e.g., five and one-eighth inches). The connection block 106 is coupled to an inlet 110 of the skid assembly 74. A valve 112 and a connection block 114 having an outlet 116 is also mounted on the skid 104. The valve 112 can be opened and closed to control flow of fracturing fluid (from the fracturing manifold 72) between the inlet 110 and the outlet 116. A fluid conduit 76 can be connected to the connection block 114 at the outlet 116 to convey fluid (e.g., fracturing fluid) from the skid assembly 74 to a fracturing tree 78 of a wellhead assembly 50, such as shown in FIGS. 5 and 6.

In at least some embodiments, such as that shown in FIGS. 7 and 8, the additional manifold 90 includes pipes 120 and a connection block 122 for routing an additional fluid through the outlet 116 and the fluid conduit 76 to a wellhead assembly 50. The additional manifold 90 is connected to an inlet 124 of a connection block 126 of the skid assembly 74. A valve 128 between the connection block 126 and the connection block 114 can be opened and closed to control flow of the additional fluid between the inlet 124 and the outlet 116. In this arrangement, the skid assembly 74 includes multiple inlets for receiving fluids, but only a single, shared outlet 116 (common to both inlet 110 and inlet 124) for routing the fluids received from the manifolds 72 and 90 to a wellhead assembly 50 through a fluid conduit 76. To facilitate connection with the additional manifold 90, the connection block 126 and the valve 128 can be positioned at an angle (e.g., thirty degrees) with respect to a horizontal plane through the fracturing manifold 72, the connection 106, and the valve 112.

The additional fluid from the manifold 90 can be used to pump a downhole tool (e.g., a tool for plugging and perforating a casing in the well) to a desired position in a well. In one embodiment, this includes operating the valve 128 to allow fluid from a pump-down manifold 90 to pass through the valve 128, out of the skid assembly 74 through the outlet 116, and into a well (in which the tool is disposed) through a single fluid line 76 and the wellhead assembly 50. The well can then be fractured by operating the valve 112 to route fracturing fluid through the outlet 116, the single fluid line 76, and the wellhead assembly 50. In one embodiment, the fracturing manifold 72 is a five and one-eighth inch manifold with a 15,000 psi rating, and the additional manifold 90 is a three and one-sixteenth inch manifold with a 10,000 psi rating. But other configurations could instead be used.

In some embodiments, the skid assembly 74 is a compact skid assembly weighing less than five thousand pounds and having dimensions of less than fifty inches by seventy inches by fifty inches having a bore through the valve 112 and connection block 114 having a diameter of five and one-eighth inch and a 15,000 psi rating. The compact size and single-outlet design allows each skid assembly 74 to be placed closely to its dedicated wellhead assembly, such as within fifteen feet or thirty feet of a fracturing tree of the wellhead assembly. This can reduce the length of pipe runs for connecting the skid assemblies to the fracturing trees. The compact size also allows the flow control equipment of the skid assembly to be more easily accessed by operators at ground level, rather than having to climb scaffolding to reach upper portions of taller assemblies. This also facilitates covering of the skid assemblies with tarps or other covers to protect the assemblies in harsh conditions. Further, compared to the use of larger skid assemblies for connecting to multiple wellhead assemblies, the use of these compact skid assemblies may reduce the expense of moving, installing, and connecting a fracturing manifold at a wellsite. And the modular design of certain embodiments is adaptable to various well spacing or configurations, which can further reduce deployment expenses.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A fracturing system comprising:

a plurality of wellheads installed at respective wells;

a plurality of fracturing trees coupled to the plurality of wellheads;

a fracturing manifold system coupled to the plurality of fracturing trees so as to enable the fracturing manifold system to provide fracturing fluid to the plurality of wellheads through the plurality of fracturing trees, wherein the fracturing manifold system includes a fracturing fluid manifold and a skid apparatus coupled in fluid communication with the fracturing fluid manifold and with only one fracturing tree of the plurality of fracturing trees, the skid apparatus including an inlet coupled to the fracturing fluid manifold, a single outlet coupled to the one fracturing tree via a fluid conduit, and a valve between the inlet and the single outlet to control flow of fracturing fluid from the fracturing fluid manifold through the skid apparatus to the one fracturing tree, and wherein the single outlet coupled to the one fracturing tree via the fluid conduit is the only outlet of the skid apparatus to a well at which the one fracturing tree is positioned and the fluid conduit is the only fluid conduit connecting the skid apparatus in fluid communication with the well at which the one fracturing tree is positioned.

2. The fracturing system of claim 1, wherein the fracturing manifold system includes multiple skid apparatuses that are each coupled in fluid communication with the fracturing fluid manifold and with only one respective fracturing tree of the plurality of fracturing trees.

3. The fracturing system of claim 2, wherein the ratio of the number of the multiple skid apparatuses to the number of fracturing trees in the plurality of fracturing trees is one to one.

4. The fracturing system of claim 1, wherein the fracturing manifold system includes at least one additional skid apparatus that is coupled to multiple fracturing trees of the plurality of fracturing trees.

5. The fracturing system of claim 1, comprising an additional fluid manifold.

6. The fracturing system of claim 5, wherein the skid apparatus includes an additional inlet coupled to the additional fluid manifold.

7. The fracturing system of claim 6, wherein the skid apparatus includes an additional valve between the additional inlet and the single outlet to control flow of another fluid from the additional fluid manifold through the skid apparatus and to the one fracturing tree via the single outlet and the fluid conduit.

8. The fracturing system of claim 1, wherein the plurality of fracturing trees includes a plurality of horizontal fracturing trees.

9. The fracturing system of claim 1, wherein the fracturing fluid manifold includes multiple branch lines coupled to a splitter.

10. The fracturing system of claim 9, wherein each of the branch lines is connected to the same number of skid apparatuses of the fracturing manifold system.

11. The fracturing system of claim 1, wherein the fluid conduit coupling the single outlet of the skid apparatus to the one fracturing tree has a diameter equal to that of a pipe of the fracturing fluid manifold.

12. A fracturing apparatus comprising:

a fracturing manifold;

a plurality of wellhead assemblies; and a plurality of skid-mounted flow control assemblies, wherein the plurality of skid-mounted flow control assemblies includes multiple modular flow control assemblies each mounted on a separate skid, each coupled to the fracturing manifold to receive fracturing fluid from the fracturing manifold, and each coupled to a wellhead assembly of the plurality of wellhead assemblies such that the plurality of wellhead assemblies is coupled to the fracturing manifold via the multiple modular flow control assemblies to facilitate routing of the fracturing fluid from the fracturing manifold to the wellhead assemblies, and further wherein each wellhead assembly of the plurality of wellhead assemblies coupled to the fracturing manifold is coupled to the fracturing manifold via a different modular flow control assembly that does not couple more than one wellhead assembly of the plurality of wellhead assemblies to the fracturing manifold and via a single fluid line that is coupled between the different modular flow control assembly and the wellhead assembly and is the only fluid line coupled between the wellhead assembly and equipment on the skid on which the different modular flow control assembly is mounted, and the fracturing apparatus does not include any skid having two flow control assemblies coupled between the fracturing manifold and wellhead assemblies of different wells.

13. The fracturing apparatus of claim 12, wherein each of the modular flow control assemblies includes an inlet to receive fracturing fluid from the fracturing manifold and only one outlet to output the received fracturing fluid toward the wellhead assembly of the plurality of wellhead assemblies that is coupled to the fracturing manifold via that modular flow control assembly.

14. The fracturing apparatus of claim 12, wherein the fracturing manifold includes connection blocks mounted on the skids of the modular flow control assemblies.

15. The fracturing apparatus of claim 12, wherein each of the modular flow control assemblies includes an additional inlet to receive fluid from an additional manifold and is configured to route the fluid received from the additional manifold to the one outlet.

16. A method comprising:

pumping a downhole tool to a desired position in a well, wherein pumping the downhole tool to the desired position in the well includes operating a first valve of a skid apparatus to route fluid from a pump-down manifold through a single fluid line coupled between the skid apparatus and a wellhead assembly at the well, wherein the single fluid line coupled between the skid apparatus and the wellhead assembly at the well is the only fluid line coupled between the skid apparatus and the wellhead assembly at the well; and fracturing the well with a fracturing fluid, wherein fracturing the well includes operating a second valve of the skid apparatus to route the fracturing fluid from a fracturing manifold through the single fluid line to the wellhead assembly.

17. The method of claim 16, comprising coupling both the fracturing manifold and the pump-down manifold to the skid apparatus.

18. The method of claim 16, wherein the skid apparatus has only a single outlet for routing fluid to the well, the method comprising coupling the single outlet to the wellhead assembly with the single fluid line.

19. The method of claim 16, comprising coupling multiple wellhead assemblies to both the pump-down manifold and the fracturing manifold via a plurality of skid apparatuses.

20. The method of claim 19, wherein coupling multiple wellhead assemblies to both the pump-down manifold and the fracturing manifold via the plurality of skid apparatuses includes coupling each of the multiple wellhead assemblies to a different skid apparatus of the plurality of skid apparatuses.

* * * * *